United States Patent [19]

King

[11] Patent Number: 4,754,510

[45] Date of Patent: Jul. 5, 1988

[54] BODY PILLOW

[76] Inventor: Harry A. King, 21 Lady La., Salem, N.H. 03079

[21] Appl. No.: 837,036

[22] Filed: Mar. 6, 1986

[51] Int. Cl.[4] ..... A47C 20/00; A47C 20/02

[52] U.S. Cl. ..... 5/431; 5/436; 5/443; 5/446

[58] Field of Search ..... 5/431, 437, 436, 434, 5/442, 443, 446, 441; D6/595, 596, 597, 598, 599, 604, 605, 601; 128/68, 78

[56] References Cited

U.S. PATENT DOCUMENTS

| | | | |
|---|---|---|---|
| D. 163,709 | 6/1951 | Ray | D6/604 |
| 1,212,515 | 1/1917 | Leavitt | 5/436 |
| 1,312,886 | 8/1919 | Bawden | 5/436 |
| 2,522,120 | 9/1950 | Kaskey et al. | 5/441 |
| 3,680,917 | 8/1972 | Harris | 5/441 |
| 3,763,509 | 10/1973 | Mittendorf | 5/442 |
| 4,060,863 | 12/1977 | Craig | 5/437 |
| 4,133,064 | 1/1979 | Petrusek | 5/441 |
| 4,173,048 | 11/1979 | Varaney | 5/442 |
| 4,473,913 | 10/1984 | Ylvisaker | 5/441 |
| 4,506,395 | 3/1985 | Ritchie, Jr. et al. | 5/431 |
| 4,584,730 | 4/1986 | Rajan | 5/431 |
| 4,624,021 | 11/1986 | Hofstetter | 5/431 |

FOREIGN PATENT DOCUMENTS

| | | | |
|---|---|---|---|
| 225739 | 9/1910 | Fed. Rep. of Germany | 5/437 |
| 2749596 | 5/1979 | Fed. Rep. of Germany | 5/442 |
| 7309246 | 10/1974 | Netherlands | 5/446 |
| 26072 | of 1908 | United Kingdom | 5/437 |

OTHER PUBLICATIONS

"Modern Dutch Wife Pillow", in *Cool Midsummer Nights' Dreams,* p. 27.

*Primary Examiner*—Michael F. Trettel
*Attorney, Agent, or Firm*—Edward A. Gordon

[57] ABSTRACT

A body pillow is provided for enfolding the body of a user at rest. The body pillow is typically an elongated flexible member having an upper section adapted to enfold the upper body and arms of the user and a lower section adapted to lie between and enfold the legs of the user. The upper body section comprises a flexible material forming an enclosure having a generally oval configuration in the vertical plane and having a filling of sufficient cushioning material whereby the upper section readily conforms to the contour of the body and embracing arms of the user. The lower leg section also comprises a flexible material forming an enclosure having a generally oval configuration in the horizontal plane and a filling of sufficient cushioning material whereby the lower section holds the legs of the user in spaced relationship and readily conforms to the contour of the legs. In one embodiment a body pillow cover is employed to provide protective and decorative features.

14 Claims, 3 Drawing Sheets

BODY PILLOW

FIELD OF THE INVENTION

This invention relates to pillows and more particularly to a body pillow.

BACKGROUND OF THE INVENTION

Pillows have long been used for support of the head during sleeping. The common pillow in widespread use today for sleeping and for some time past, generally has a rectangular shape and is generally formed of upper and lower panels of flexible material such as fabric, or the like, which are attached together about their corresponding edges and which enclose a flexible resilient material, formed from natural or synthetic materials, to comfortably support the head during sleep. One example of such prior art pillow is disclosed in U.S. Pat. No. 3,555,580. Such pillows are generally provided with pillow covers which are provided with an opening for insertion and removal of the pillow. Such pillow covers provide protection against soiling as well as a decorative appearance.

Another type of pillow of the prior art is a generally smaller pillow whose principal function is to provide a decorative appearance. Such decorative pillows are generally constructed in the same manner as bed pillows and because of their smaller size are formed in various shapes.

Another type of prior art pillow is the posture pillow which is used for exercise and therapy in posture maintenance and correction and formed of a core of rigid material and having a flexible material around the core and a cylindrical cover of flexible material. Such a posture pillow is illustrated and described in U.S. Pat. No. 3,842,453.

Prior art pillows are currently designed for use under the head during sleep and are generally constructed in fairly specific and standard widths, lengths, thicknesses and degrees of softness (i.e. firm, medium, and soft). While there are some small variations between manufacturers usually resulting more from the stuffing or filling material used, such pillows are for the most part quite standard and relatively interchangeable from one manufacturer to another, as exemplified by pillow covers or cases; usually made by a different group of manufacturers, fitting all of such pillow products quite adequately. The approximate dimensions of these typical prior art pillows commonly referred to as standard, queen and king sizes are illustrated in Table 1.

TABLE 1

| | Unfilled (inches) | | | Filled (inches) | | |
|---|---|---|---|---|---|---|
| | Std. | Queen | King | Std. | Queen | King |
| Length | 26 | 30 | 36 | 23 | 27 | 33 |
| Width | 20 | 20 | 20 | 17 | 17 | 17 |
| Thickness | — | — | — | 8 | 8 | 8 |

While such prior art pillows are useful in providing a head rest or are of decorative or therapeutic value, none of the prior art provides a body pillow which is constructed and arranged to provide the novel features of the present invention including a cushioning support for the entire body of the user, separating and cushioning of the arms and legs of the user, all while providing an overall enfolding or embosoming effect to the user.

Accordingly it is a desirable object of the present invention to provide a pillow for the body of the user which promotes more restful and comfortable sleep.

Another desirable object of the present invention is to provide a body pillow which cushions and enfolds the entire length of the body of the user while comfortably providing a cushioned separation of the arms and legs from each other.

A still further desirable object of the present invention is to provide a body pillow having the above-described desirable objects which accomodates various sizes, is easy to manufacture and low in cost.

The above and other desired objects, apparent from the drawings and following description, may be attained by the apparatus, construction, arrangements and combinations, subcombinations and parts which comprise the present invention, preferred embodiments of which are illustrative of the mode in which applicant has contemplated applying the principal, being set forth in detail in the following description and illustrated in the accompanying drawings.

SUMMARY OF THE INVENTION

The present invention provides a novel body pillow for enhancing sleep or rest which is constructed and arranged to cushion and enfold the entire length of the body while providing a comfortable cushioned separation of the arms and legs of the user. More particularly, in accordance with the present invention, the body pillow comprises a generally elongated structure having an upper portion, hereinafter sometimes referred to as the body portion, designed and contoured to be positioned or lie adjacent the chest of the user while separating and cushioning the arms and a lower portion, hereinafter sometimes referred to as the leg portion, designed and contoured to be positioned or to lie between the legs of the user and to thereby separate and cushion the legs from each other. The body portion preferably has a generally oval or eliptical configuration but can be formed with a generally cylindrical shape and additionally can also provide for gently tapering to the leg portion. The leg portion is contiguous with the body portion and constructed and arranged to provide a generally horizontal rectangular cushion support allowing the upper leg (when the user is sleeping on one side) to be comfortably cushioned in spaced relationship from the lower leg. The body pillow is formed of a flexible material such as fabric or the like which encloses a cushioning material which may be any suitable flexible material such as down, natural or synthetic materials in foam or particulate form, and the like. Suitable body pillow covers are also provided.

BRIEF DESCRIPTION OF THE DRAWING

For a fuller understanding of the nature and desired objects of this invention, reference should be made to the following detailed description taken in connection with the accompanying drawing, wherein like reference characters refer to corresponding parts throughout the several views of the preferred embodiments of the invention and wherein.

DETAILED DESCRIPTION OF THE PREFERRED EMBODIMENTS

Figure 1:
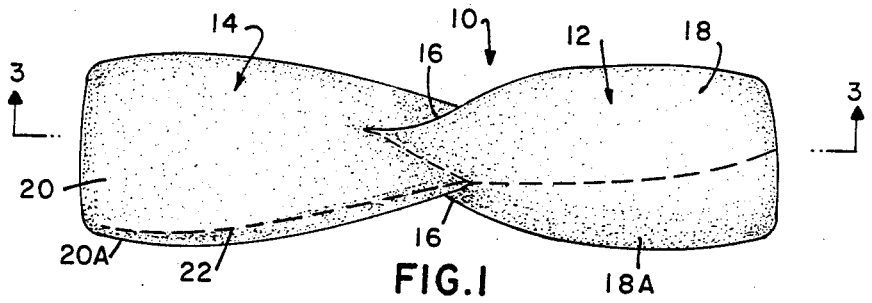
FIG. 1 is a side perspective view of a body pillow of the present invention having the body portion shown as having a generally round or cylindrical configuration.
Figure 2:
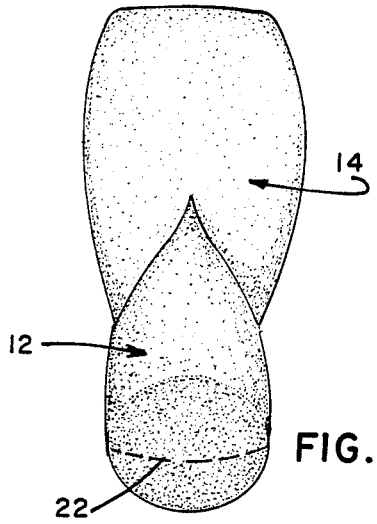
FIG. 2 is top perspective view of the body pillow of FIG. 1.
Figure 3:
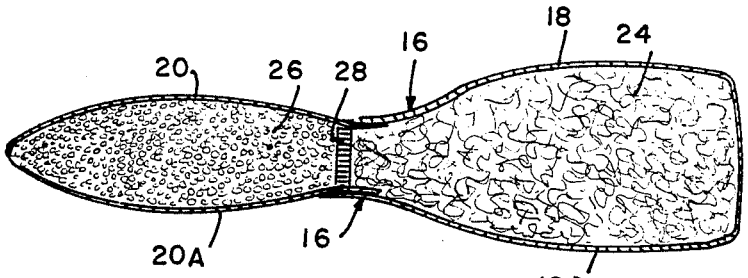
FIG. 3 is a sectional view taken substantially along the line 3—3 of FIG. 1.

Referring now to the drawings, and particularly to FIGS. 1-3, there is shown generally at 10 a body pillow in accordance with the invention. The body pillow 10 includes an upper portion or section 12, hereinafter sometimes referred to as the body portion, and a lower portion or section 14, hereinafter sometimes referred to as the leg portion. The upper body portion 12 is generally cylindrical in shape and has a length of approximately one half of the total length of the body pillow 10. The lower leg portion 14 which is contiguous with the body portion 12, has a relatively flat generally rectangular or eliptical configuration and forms the lower half of the body pillow 10. In the embodiment illustrated, the body portion preferably tapers gently toward the center of the body pillow 10. Similarly, the leg portion 14 preferably tapers laterally toward the center of the body pillow. Additionally the end of the body portion 12 can be provided with an inward curvalinear portion 16 to accomodate the knees of the user when drawn to a bent position as hereinafter described with respect to FIG. 8. The body portion 12 and leg portion 14 can be formed of opposing panels or covers 18, 18A and 20, 20A respectively and sewn together by suitable stitches 22 (shown by dotted lines) well known to those skilled in the art. The panels 18, 18A, 20, 20A are formed of flexible material such as fabrics, and the like. Disposed within the panel covers 18, 18A, 20 and 20A is a suitable cushioning material 24 such as down feathers, cotton, and other natural or synthetic foams, fibers, particulates, and the like. It is to be understood that different cushioning materials can be used for the leg portion and the body portion of the body pillow. For example, down feathers can be used for the cushioning material 24 in the body portion 12 while using foam rubber for the cushioning material 26 in the leg portion 14. When different cushioning materials are used a suitable barrier 28 is preferably provided to maintain separation of the cushioning materials within their respective areas of the body pillow.

Figure 4:
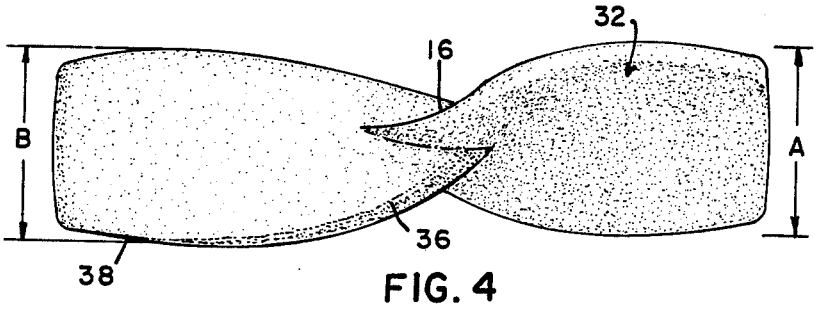
FIG. 4 is a side perspective view of an alternate form of a body pillow of the present invention illustrating the body portion as having a generally elliptical configuration.
Figure 5:
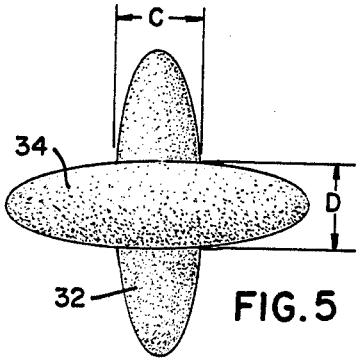
FIG. 5 is a lower end perspective view of the body pillow of FIG. 4.

Referring now to FIGS. 4 and 5 there is illustrated an alternate embodiment of the body pillow of the present invention. The body pillow shown generally at 30 is provided with an upper body portion 32 which is provided with a generally elliptical or oval configuration having the longest dimension in the vertical plane. The lower leg portion 34 which is provided with a generally elliptical or oval configuration having its longest dimension in the horizontal plane can also be constructed and arranged to taper from a greater thickness at the upper end 36 to a lesser thickness at the foot or lower end 38. In other respects the body pillow 30 is constructed and arranged in the same manner as the body pillow 10.

The optimum length of the body pillow is one which extends from just below the chin to the bottom of the feet of the user. This optimum length has been determined and reported by Henry Dreyfuss in his work entitled: "The Measure of Man", Whitney Library of Design 1960. As reported therein, the length from the bottom of the chin to the bottom of the feet is set forth in Table 2.

TABLE 2

| Subject | 2½ percentile | 50 percentile | 97½ percentile |
|---|---|---|---|
| Adult American Female | 50.2 in. | 55.4 in. | 59.6 in. |
| Adult American Male | 56.4 in. | 60.4 in. | 64.2 in. |

Thus, the optimum length of the body pillow in order to accomodate more than 95% of the adult American male and female population would have an actual filled length of approzimately 64 inches and, in tests, such a length has been found to behave as desired. The shortest length that would be satisfactory for just 50% of the adult American female population would be 55 inches. Therefore the length of the body pillow would range from between about 45 inches to 72 inches filled length with a preferable length of between about 55 inches to 68 inches in filled length. It is to be understood that shorter lengths can be made to accommodate children.

The overall width of the adult American at the shoulders (as derived from the Henry Dreyfuss reference previously mentioned) and including 95% of the adult population is set forth in Table 3.

TABLE 3

| Subject | 2½ percentile | 50 percentile | 97½ percentile |
|---|---|---|---|
| Adult American Female | 14.2 in. | 15.7 in. | 16.8 in. |
| Adult American Male | 16.2 in. | 17.9 in. | 19.8 in. |

The difference between these overall widths and the width of just the chest is approximately 6 inches in adult males and 3½ inches in adult females. Therefore from these measurements it was determined that a suitable vertical width of the body portion of of a filled body pillow as measured, for example, along the line A—A of FIG. 4 can be from between about 14 inches to 26 inches, while a preferred width was found to be between about 16 inches to 22 inches.

The horizontal width of the leg portion 34 as measured, for example, along the line B—B of FIG. 4 can be from between about 14 to 26 inches and preferably between about 16 to 22 inches as described with respect to the body portion to accommodate the majority of users.

The horizontal thickness of the body portion 32 as measured at its greatest width, for example along the line C—C of FIG. 5, can be from 3 to 8 inches and is preferably from 4 to 7 inches to thereby accommodate the majority of users. Similarly the vertical thickness of the leg portion 34 as measured, at its greatest width, for example, along the line D—D of FIG. 5 can be from 3 to 8 inches as described with respect to the body portion, the main requirement being that the width or thickness be sufficient to maintain the users legs in spaced comfortable relationship.

While the formation of the body pillow of the present invention has been described above with respect to dimensions which have been found suitable for the most prevalent or common size range of users, it is to be understood that the present invention contemplates body pillows having dimensions of greater or lesser size dimensions to accommodate other sizes and/or desires of users.

Figure 6:
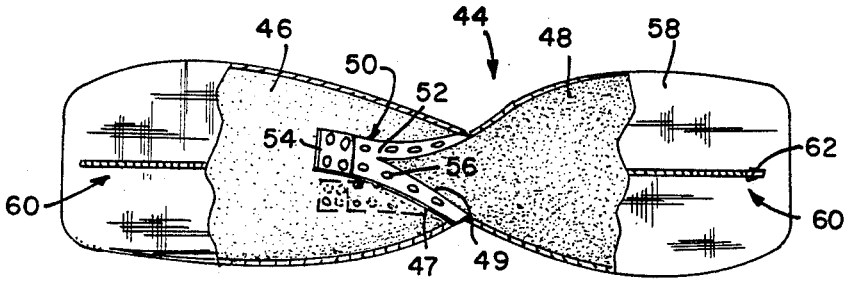
FIG. 6 is a side perspective view partially broken away illustrating an alternate embodiment of the body pillow of the present invention.

Referring now to FIG. 6 of the drawing, a modified embodiment of the invention is illustrated wherein the body pillow, shown generally at 44, is fabricated from a separate body portion 48 and a separate leg portion 46 which are joined by adjustable fastening means shown generally at 50 to form a single unitary structure. In this embodiment the leg portion 46 and body portion 48 are provided with mating ends 47 and 49 respectively each of which are provided with a generally concave configuration (not shown) to thereby mate with each other. The concave configuration of the mating end 49 being generally in the vertical plane while the concave configuration of the mating end 47 is generally in the horizontal plane to thereby be in register with each other when joined together. The adjustable fastening means as illustrated comprise a first upper collar element 52 associated with the body member 48 and a second upper collar element 54 associated with the leg member 46. The collar members 52 and 54 are provided with suitable mating frictional fasteners 56 for releasably attaching the body member 48 and leg member 46 together. Corresponding lower collar members (shown in phantom) are provided on the other or lower side of the body pillow 44. It is believed apparen then that by selection of the position of the fastening means 56 a change in length of the body pillow structure 44 can be effected. As further illustrated in FIG. 6 the body pillow 44 is enclosed with a suitable flexible cover 58 constructed to conform generally to the shape of the body pillow 44 and is provided with a transverse opening 60 which preferably extends in substantially the length of the body pillow 44 to facilitate insertion and removal of the body pillow 44. The opening 60 is suitably provided with a closure means such as zipper means 62.

Figure 7:
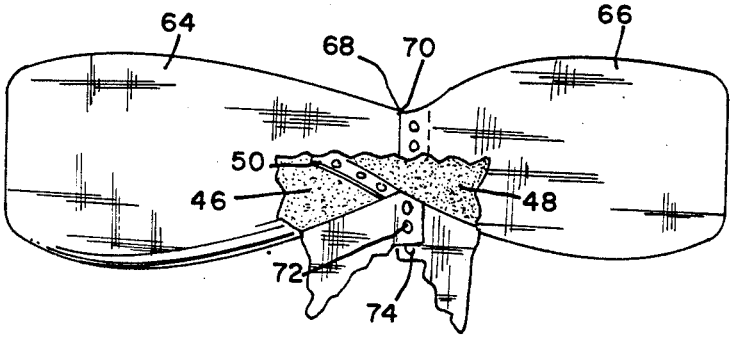
FIG. 7 is an elevation view of a modified form of the length adjusting feature of the body pillow.

In the modified embodiment of the invention shown in FIG. 7 the leg member 46 and body member 48 are the same as illustrated in FIG. 6. A cover means for enclosing the body member and leg member to form the body pillow is preferably comprised of two cover sections 64 enclosing the leg member 46 and 66 enclosing the body member 48. Each cover section 64 and 66 is provided with openings 68 and 70 for insertion and removal of the leg member 46 and the body member 48. Disposed adjacent to the openings 68 and 70 of the cover sections are fastening means for attaching the cover section together. As illustrated the fastening means comprise frictional fasteners 72 disposed on cover section 64 adjacent the opening 68 and mating fasteners 74 disposed on cover section 66 adjacent opening 70 to secure the cover sections together and form a unitary body pillow structure.

It is to be understood that additional fastener means (not shown) may be provided on the cover section to provide for limited adjustment of the overall length of the cover section and thereby serve to provide length adjustment of the body pillow, as desired, in lieu of or in addition to the internal fasteners 50 of FIG. 6.

It should also be understood that the adjustment of the position of the fasteners 72 and 74 separately or together with fasteners 54 and 56 provide a limited adjustment of the firmness of the body pillow since a change in length, shorter for example, will effect a general firming up of the cushioning material.

It is to be understood that the degree of softness of firmness of the body pillow can be selectively controlled by varying the type and amount of cushion filler employed as is well known in the art of head pillows. While the amount and type of cushioning material can be varied the main requirements are that the body pillow be relatively easily deformed to the contour of the user particularly with respect to the body portion; and, that with respect to the leg portion, the legs be maintained in spaced relation to each other so that one leg does not sharply feel the other leg. Excessive filling and resulting hardness of the body pillow will result in a body pillow which feels too thick and uncomfortable both between the legs and next to the chest of the user.

It has been found that between about 25% to 75% and preferably between about 35% to 65% of the amount of cushion material filling used in a medium firmness comparable size by area of a head pillow provides a suitable cushioning effect.

Figure 8:
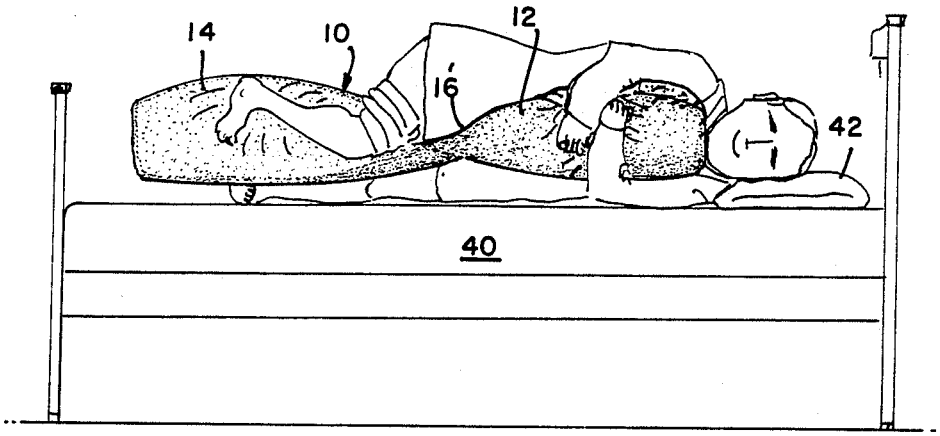
FIG. 8 is a side perspective view of a body pillow showing a user.

Referring now to FIG. 8 there is illustrated one manner of using a body pillow of the type described and shown in FIG. 1 for example. As illustrated the body pillow 10 may be used on a bed 40 with the user lying on his left side with his head on a bed pillow 42. The body portion 12 enfolds the upper body and is embraced by the arms of the user. The lower leg portion 14 lies between the legs of the user and holds them in cushioned comfortable spaced relationship to each other. The curvalinear portion or groove 16 provides a natural receptacle for the users knees when moved to the position illustrated.

The cushion materials having utility in the practice of the invention are numerous and varied and can be selected from a wide group. They may be natural or synthetic in origin and may be in various forms including down. fibers, particulates, foams and the like. One particularly suitable product is a polyester fiber filling sold under the trademark "HOLLOFILL II" (E. I. du Pont de Nemours & Company) which is reported to be washable and quick drying. Additionally a combination or mixture of filler cushion materials can be used as well as different filler materials for the body portion and the leg portion of the body pillow. Similarly the body pillow cover may be selected from a wide variety of flexible fabric materials having both protective and decorative features.

In a still further embodiment contemplated by the present invention, the cushioning material can, if desired, be a fluid material such as air or water. In such embodiments the flexible cover enclosing the cushioning material is formed from fluid impervious materials such as rubber and plastics well known to those skilled in the art.

While the invention has been described with respect to preferred embodiments it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrated and not in limiting sense.

What is claimed is:

1. A body pillow for supporting the body of a user at rest, said body pillow comprising:

an elongated flexible member having an upper section providing a generally vertical surface and a lower section providing a generally horizontal surface relative to each other;

said upper section being formed of a flexible material forming a generally vertical portion having a generally oval cross section and having a filling of sufficient cushioning material whereby said upper section readily conforms to the contour of the upper body and embracing arms of said user;

said lower section being formed of a flexible material forming a generally horizontal portion having a generally oval cross section and a filling of sufficient cushioning material whereby said lower section holds said legs of said user in spaced relationship and readily conforms to the contour of said legs.

2. The body pillow of claim 1 further comprising a cover member of flexible fabric enclosing said body pillow;

said cover member having a body pillow-receiving opening disposed therein.

3. The cover member of claim 2 further comprising means for adjusting the length of said cover whereby the length of said body pillow is correspondingly adjusted.

4. A body pillow for supporting the body of a user while at rest in a generally horizontal position, said body pillow comprising:

an elongated flexible member having a sufficient length to extend from a point adjacent the chin of the user to the feet of the user;

said elongated flexible member having an upper body section adapted to support the upper body of said user and a lower leg section adapted to lie between said support the legs of said user;

said upper body section providing a generally vertical surface and said lower section providing a generally horizontal surface relative to each other.

said upper body section comprising an enclosure member providing a generally vertical portion having a generally elliptical cross section and tapering gently toward said leg section and a filling of sufficient cushioning material whereby said upper body section readily conforms to the contour of the upper body and embracing arms of said user;

said lower leg section comprising an enclosure member providing a generally horizontal portion having a generally elliptical cross section which tapers toward said body section and a filling of sufficient cushioning material whereby said lower leg section holds said legs of said user in spaced relationship and readily conforms to the contour of said legs.

5. The body pillow of claim 4 wherein the length of said body pillow is between about 45 to 72 inches.

6. The body pillow of claim 4 wherein the length of said body pillow is between about 55 to 68 inches.

7. The body pillow of claim 4 wherein the width of said upper body section is between about 14 to 26 inches.

8. The body pillow of claim 4 wherein said upper body section comprises an enclosure member having a generally round cross section tapering toward said lower leg section.

9. The body pillow of claim 4 wherein said upper body enclosure member and said lower leg enclosure member are integral and further comprising a barrier means separating the cushioning material of said upper body section from the cushioning material of said lower leg section.

10. The body pillow of claim 4 wherein the plane of said body section is disposed at approximately 90 degrees to the plane of said leg portion.

11. The body pillow of claim 4 wherein said upper body section has an inwardly contoured area juxtaposed to said lower leg section.

12. The body pillow of claim 4 where the cushioning material is a fluid selected from the group consisting of gases and liquids.

13. The body pillow of claim 4 wherein the cushioning material is a particulate material.

14. The body pillow of claim 4 wherein the cushioning material is a foam material.

* * * * *